US005618016A

United States Patent [19]

Garland et al.

[11] Patent Number: 5,618,016

[45] Date of Patent: Apr. 8, 1997

[54] SWING LINKAGE

[75] Inventors: Thomas A. Garland, 76 Reservoir Cir., Jamestown, R.I. 02835; George A. Wood, Lincoln, Mass.

[73] Assignee: Thomas A. Garland, Jamestown, R.I.

[21] Appl. No.: 300,740

[22] Filed: Sep. 2, 1994

[51] Int. Cl.[6] ..... A47F 5/12

[52] U.S. Cl. ..... 248/133; 248/144; 248/398; 297/281; 74/106

[58] Field of Search ..... 248/133, 144, 248/130, 371, 398; 297/281, 273, 261, 260, 344.15, 357; 74/106; 414/917; 5/108, 109

[56] References Cited

U.S. PATENT DOCUMENTS

| | | | |
|---|---|---|---|
| 674,910 | 5/1901 | Dutton | 297/281 X |
| 869,122 | 10/1907 | Witte | 297/326 X |
| 1,132,432 | 3/1915 | Brzozowski | 5/108 |
| 1,354,907 | 10/1920 | Hopaidszka | 5/109 |
| 2,270,172 | 1/1942 | Ruegger . | |
| 2,470,364 | 5/1949 | Niederhauser . | |
| 2,565,666 | 8/1951 | Schaefer | 297/326 X |
| 2,674,386 | 4/1954 | Larson | 414/917 X |
| 2,908,917 | 10/1959 | Pinson | 5/109 |
| 3,217,682 | 11/1965 | Christianson | 74/106 X |
| 3,357,736 | 12/1967 | McCarthy . | |
| 4,656,680 | 4/1987 | Wilson | 5/108 |
| 4,822,033 | 4/1989 | Kohus et al. | 297/273 X |
| 4,861,106 | 8/1989 | Sondergeld . | |
| 4,911,499 | 3/1990 | Meeker | 297/281 X |
| 5,005,905 | 4/1991 | Sondergedl . | |
| 5,244,252 | 9/1993 | Serber . | |

FOREIGN PATENT DOCUMENTS

| | | |
|---|---|---|
| 1099705 | 10/1956 | Germany . |
| 659179 | 6/1983 | Switzerland . |
| 11376 | 5/1987 | United Kingdom . |

OTHER PUBLICATIONS

Nicholas P. Chironis Mechanisms & Mechanical Devices Sourcebook, 5 Linkages for Straight–Line Motion, 1991 McGraw–Hill, Inc., USA, 3 ppg.

International Searching Authority, PCT International Search Report, 07 Feb. 1996.

*Primary Examiner*—Derek J. Berger
*Assistant Examiner*—Anita M. King
*Attorney, Agent, or Firm*—Fish & Richardson P.C.

[57] ABSTRACT

A linkage assembly includes a first link connected at a first point to a translation mechanism attached to a support structure. The translation mechanism is arranged to allow the first point of the first link to translate along a substantially straight axis. A second link is pivotally connected at a first point to the support structure, and at a second point to the first link. A second point of the first link travels on or near an arc of substantially constant finite radius when the first link pivots with respect to the second link.

29 Claims, 9 Drawing Sheets

Figure 1A:
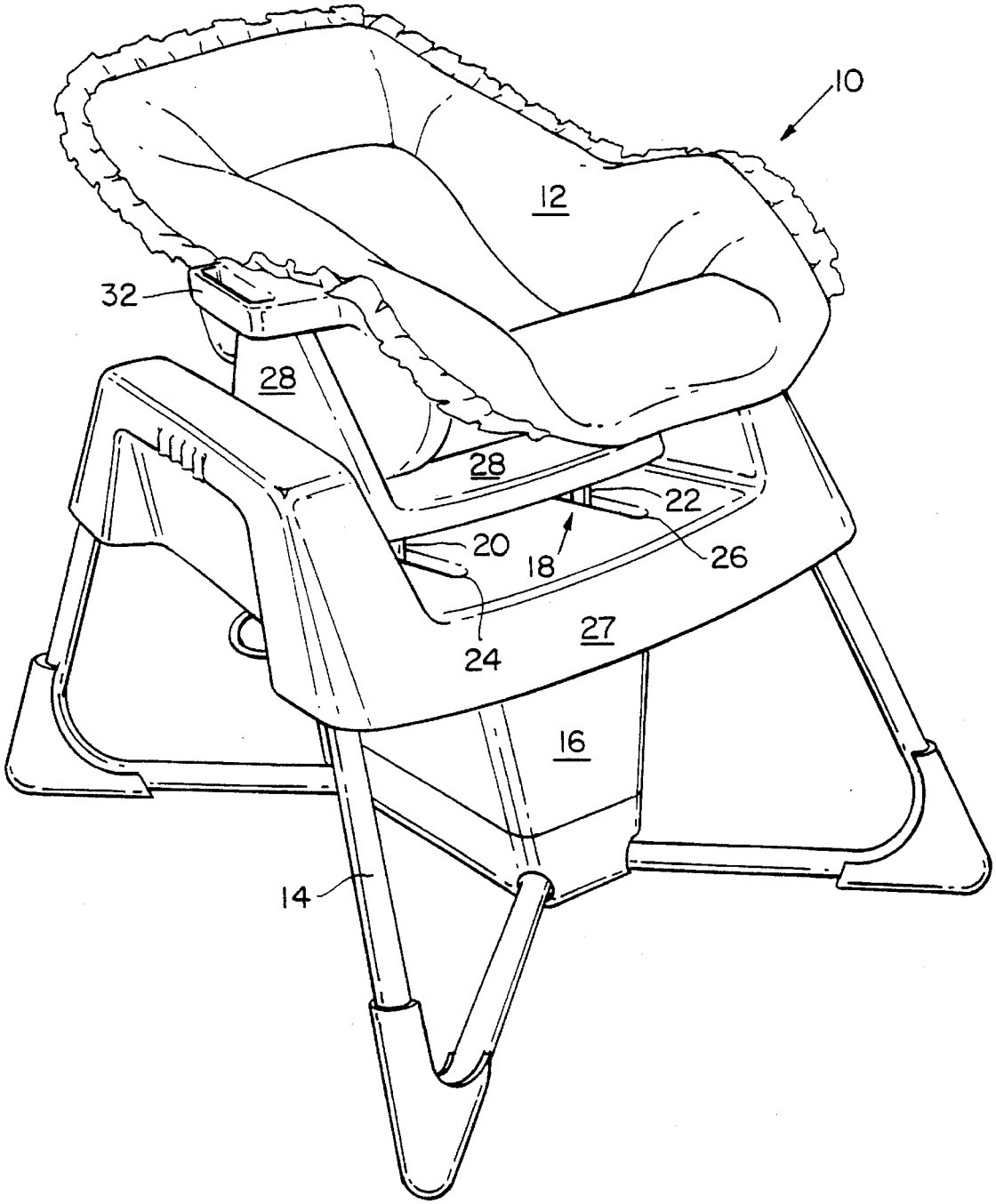

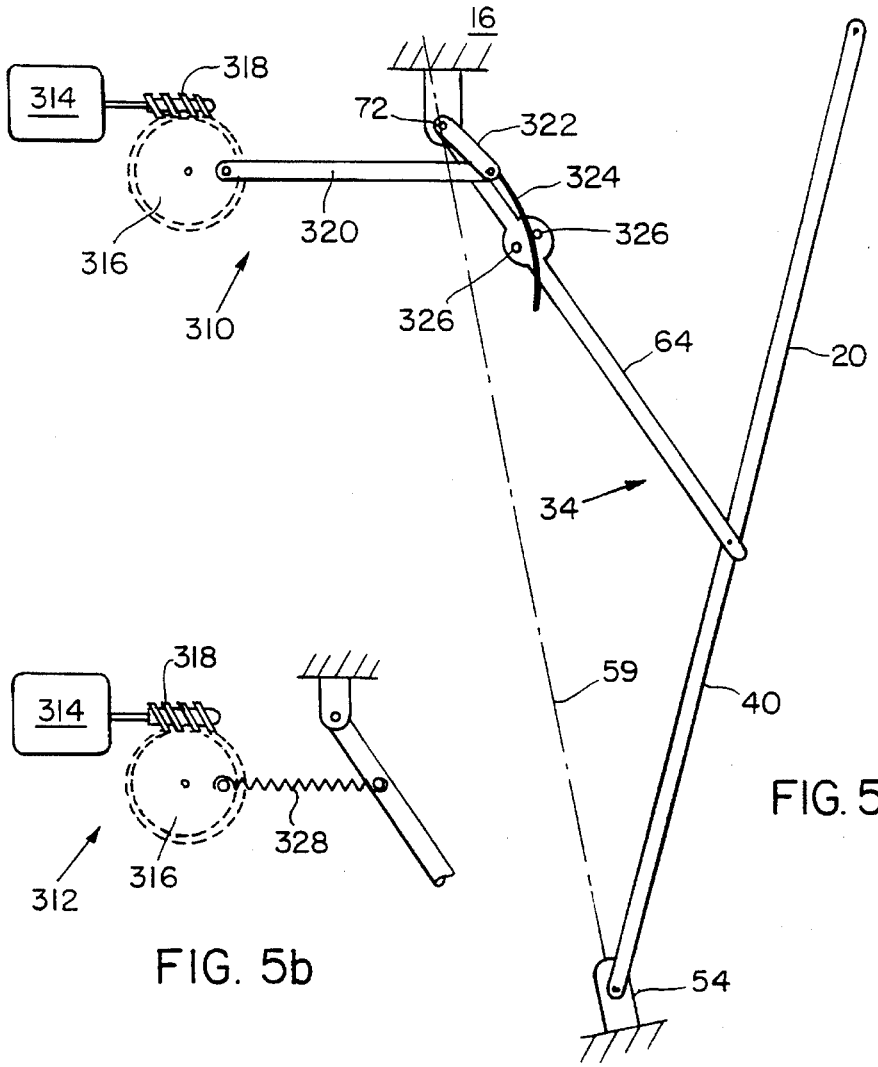
FIG. 5a
FIG. 5b
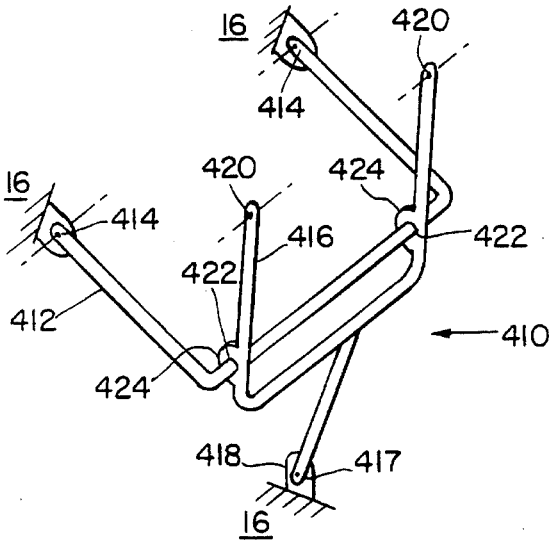
FIG. 6a
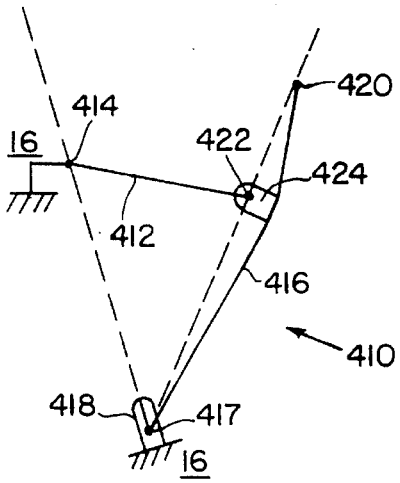
FIG. 6b

SWING LINKAGE

The present invention relates in general to linkage assemblies, and more particularly concerns linkages for producing arc or arc-like paths of motion.

A search of classes 297/273, 281, 282, 278, 320, 216.19, and 280 has located U.S. Patent Nos. 5,244,252; 5,005,905; 4,861,106; 3,357,736; 2,470,364; 2,270,172; German Patent No. 1,099,705; Swiss Patent No. 659,179; and U.K. Patent No. 11,376, which furnish background for the invention.

According to one aspect of the invention, a linkage assembly includes a first link connected at a first point to a translation mechanism attached to a support structure. The translation mechanism is arranged to allow the first point of the first link to translate along a substantially straight axis. A second link is pivotally connected at a first point to the support structure, and at a second point to the first link. A second point of the first link travels on or near an arc of substantially constant finite radius when the first link pivots with respect to the second link.

Among other advantages of this aspect of the invention, the links may be selected to provide a desired path of motion at a load-bearing point on one or both of the links. For instance, it may be desirable to configure the linkage so that the second point of the first link travels on or near an arc of substantially constant radius, where the center of the arc is located well above the linkage. A load, such as a chair, secured to the linkage at this second point would thus travel through an arc-like path as the first and second links of the linkage pivot with respect to one another. The motion of the chair would thus be much as if it were a pendulum supported from the approximate center of the arc-like path. Accordingly, a person, such as a child, seated in the chair experiences a sensation similar to that of being swung from an overhead point, without the need for an overhead linkage that may be aesthetically unappealing and cumbersome, and which may also make placing and removing the child from the chair difficult.

In one embodiment of this aspect of the invention, when the first link (which is substantially straight) pivots with respect to the second link (which is also substantially straight), a second point of the first link travels on or near an arc of substantially constant radius. The axis of the translation mechanism (e.g., a slider or a link pivotally attached at one end to the support structure and at the other end to the first point of the first link) intersects (or nearly intersects) both the first point of the second link, and the center of the arc.

As to the dimensions of the linkage assembly, the distance between the first and the second points of the first link is greater than the distance between the first and the second points of the second link. Further, the distance between the first and the second points of the second link approximately equals the distance between the second point of the second link and the second point of the first link, plus the distance along the axis between the first point of the second link and the arc.

A load (e.g., a chair releasably attached to a chair support) is pivotally attached at the second point of the first link. A load control mechanisms controls a rotational orientation of the load. For example, the load control mechanism may be a second linkage assembly connected to the load. The axis of the translation mechanism in this second linkage intersects the center of the arc. Alternatively, the load control mechanism may comprise a second translation mechanism (e.g., a slider) attached to a fourth link. The second translation mechanism is arranged to allow a third point of the second link to translate along a substantially straight second axis with respect to the fourth link. This second axis intersects the center of the arc. The first point of the first link may be either above or below the first point of the second link.

A brake mechanism is provided for arresting the motion of the linkage assembly, and a drive mechanism (comprising, e.g., a motor and a spring) is provided for driving the linkage assembly.

According to another aspect of the invention, a linkage assembly includes a first link connected at a first point to a translation mechanism attached to a support structure. The translation mechanism is arranged to allow the first point of the first link to translate along a substantially straight axis. A second link is pivotally connected at a first point to the support structure, and at a second point to the first link. A load control mechanism controls a rotational orientation of a load attached to the first link.

Among other advantages of this aspect of the invention, the load control mechanism may be configured so that the load pivots as the first link rotates with respect to the second link.

Numerous other features, objects, and advantages of the invention will become apparent from the following detailed description when read in connection with the accompanying drawings, in which:

FIG. 1*a* is a perspective view of a rocker seat.

Figure 1E:
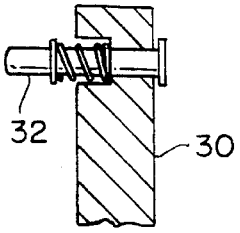
Figure 1B:
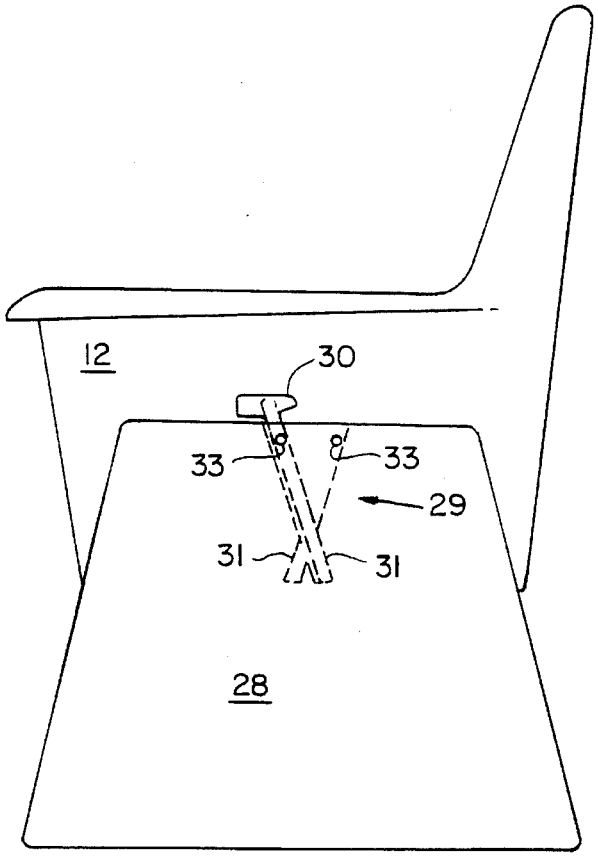

FIG. 1*b* is a side view of the rocker seat showing a tilt/latching mechanism.

Figure 1C:
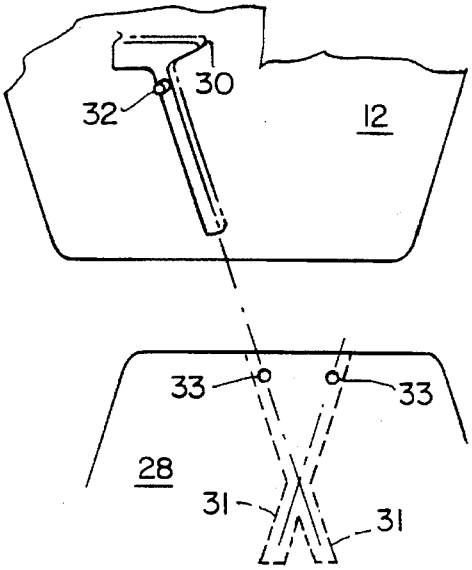

FIG. 1*c* is an exploded detail view of the tilt/latching mechanism.

Figure 1D:
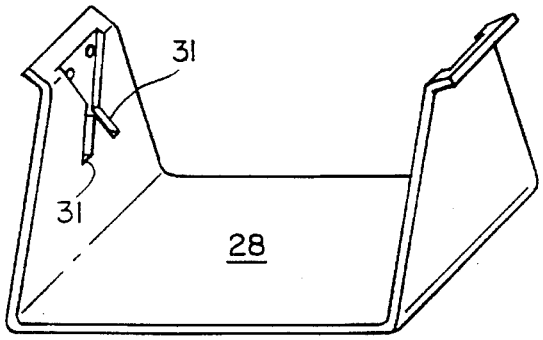

FIG. 1*d* is a perspective view of a portion of the tilt/latching mechanism.

FIG. 1*e* is a cutaway view of a portion of the tilt/latching mechanism.

Figure 2A:
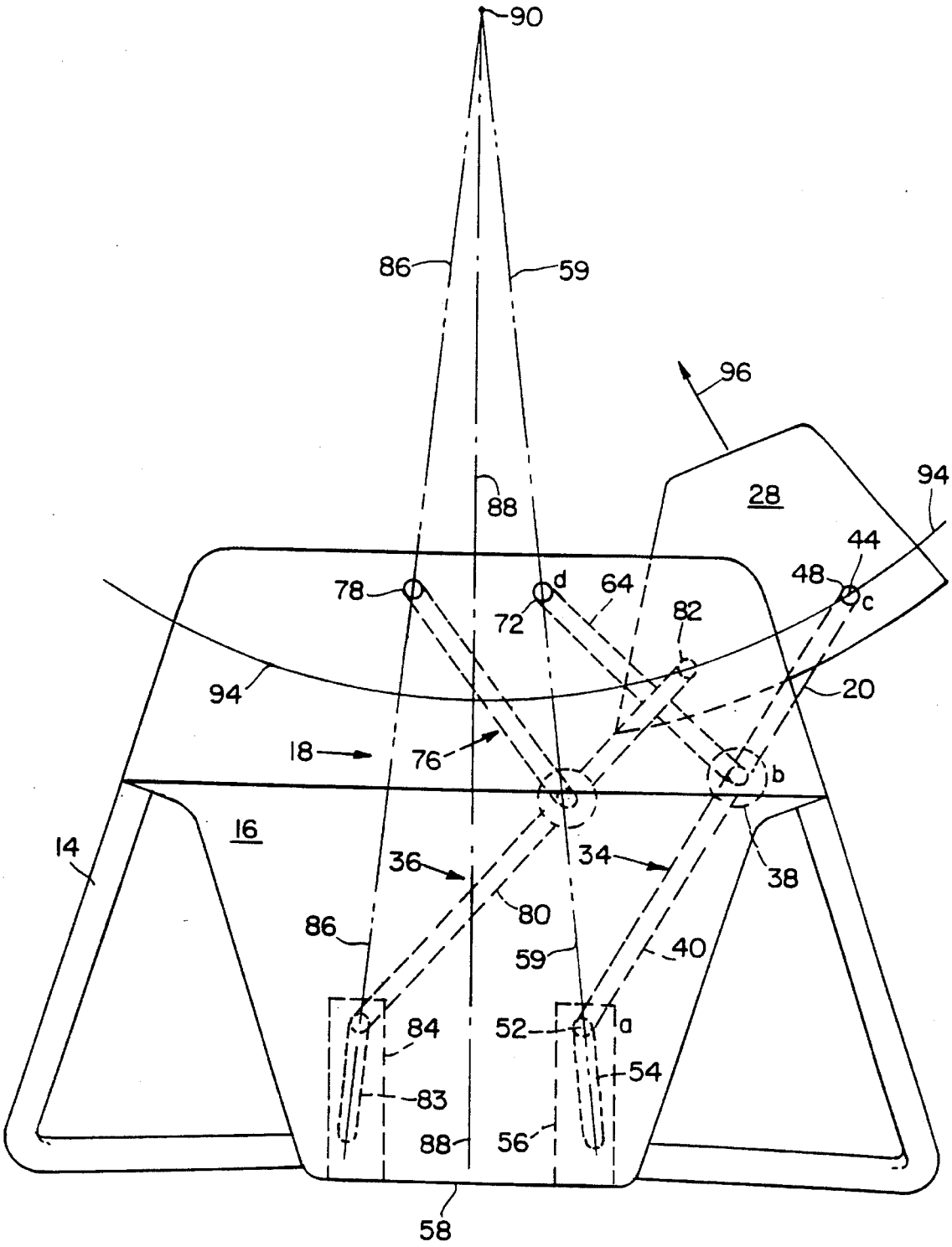
Figure 2B:
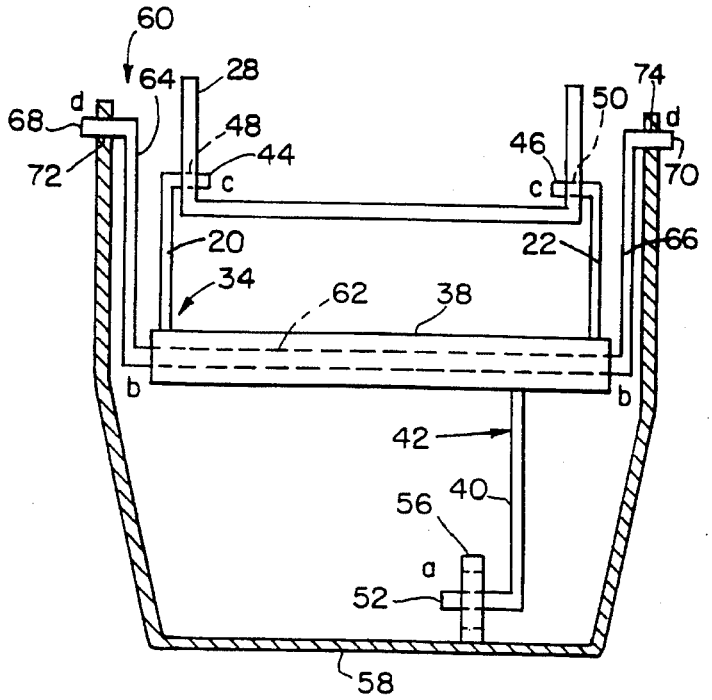
Figure 2C:
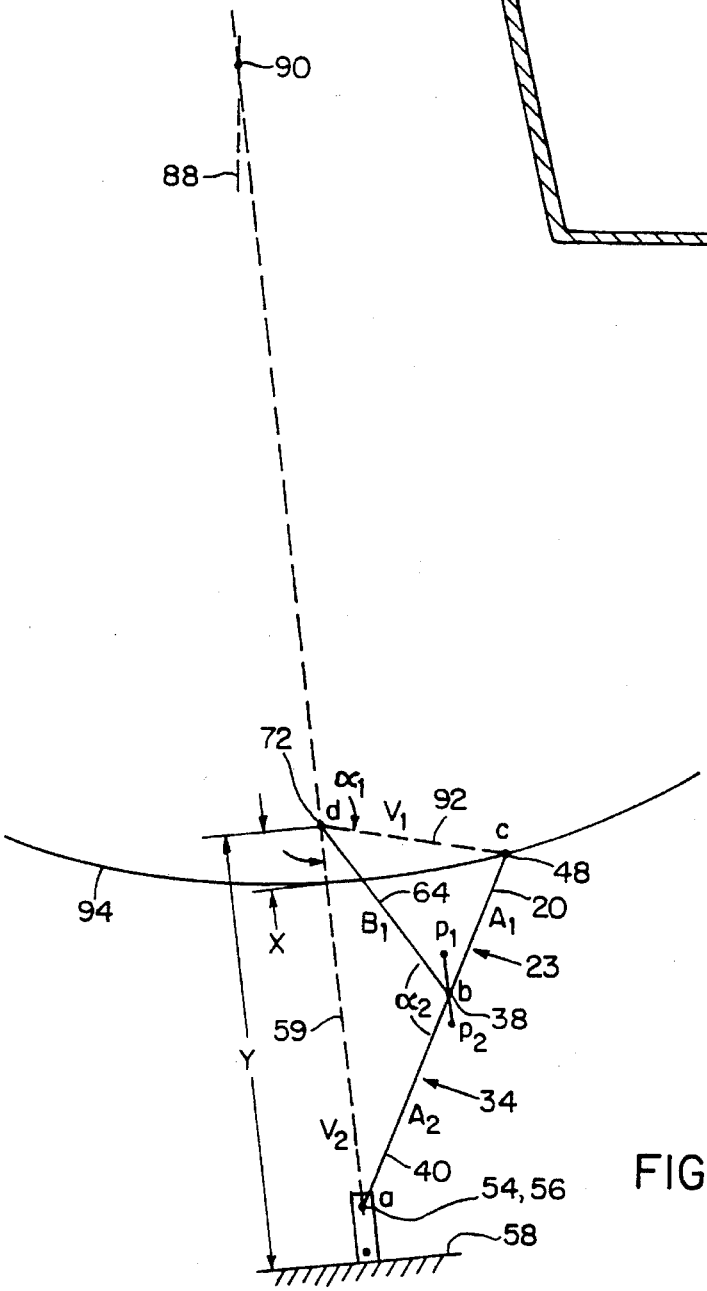

FIGS. 2*a*, 2*b*, and 2*c* are side, front, and schematic side views, respectively, of a linkage assembly of the rocker seat.

Figure 3A:
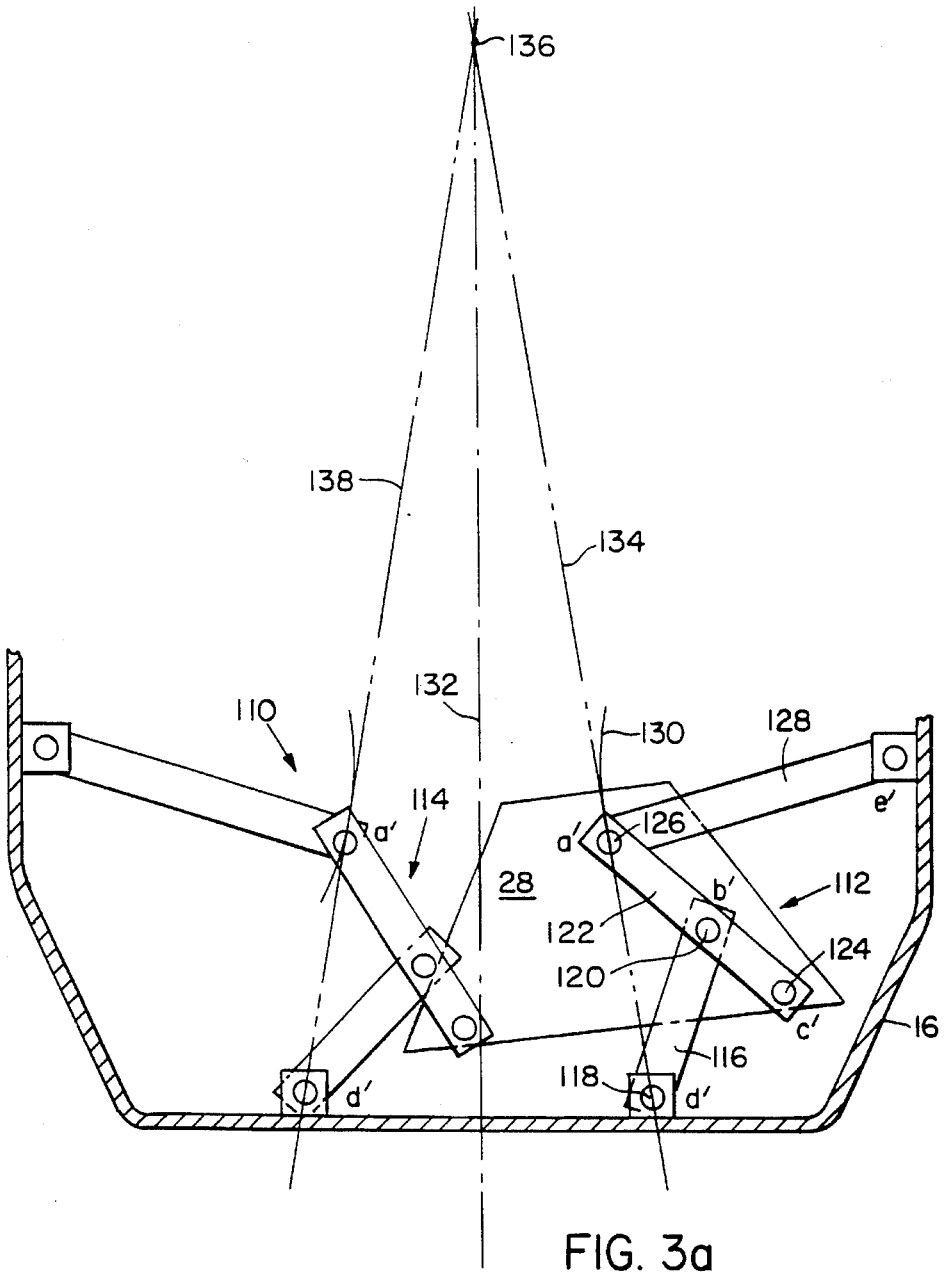
Figure 3B:
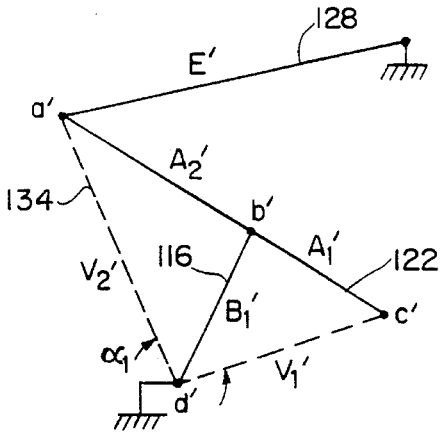

FIGS. 3*a* and 3*b* are side and schematic views, respectively, of another linkage assembly of the rocker seat.

Figure 3C:
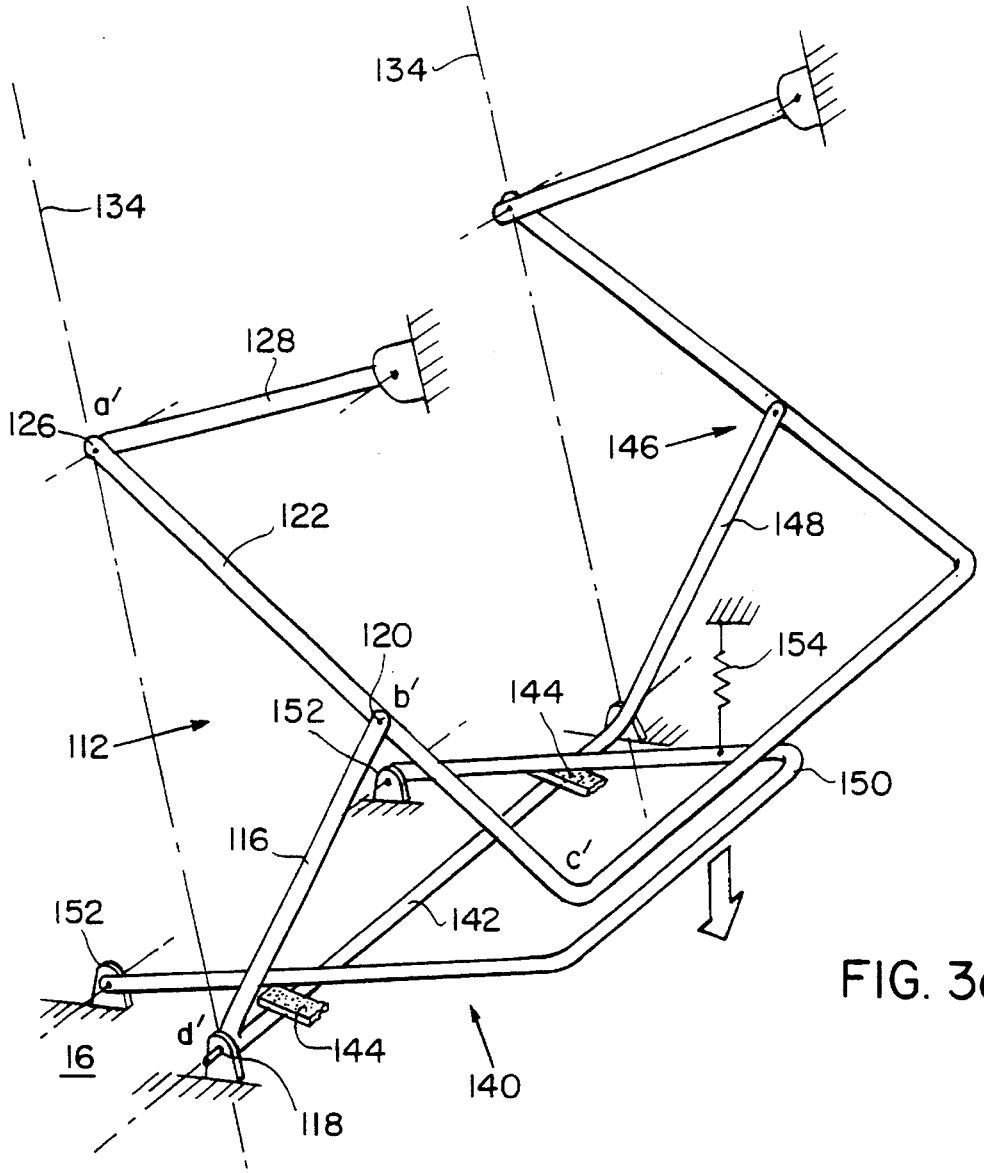
Figure 3D:
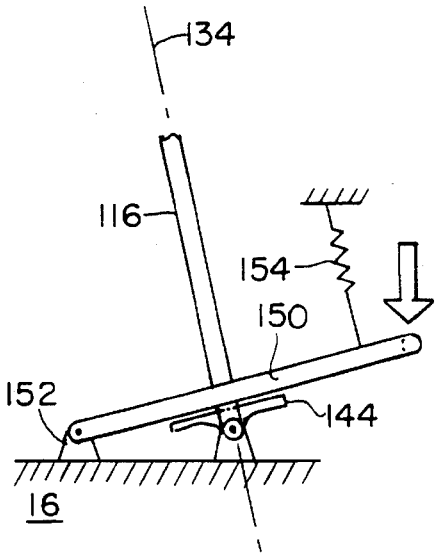

FIGS. 3*c* and 3*d* are schematic perspective and side views, respectively, of a brake mechanism for the rocker seat of FIGS. 3*a* and 3*b*.

Figure 4A:
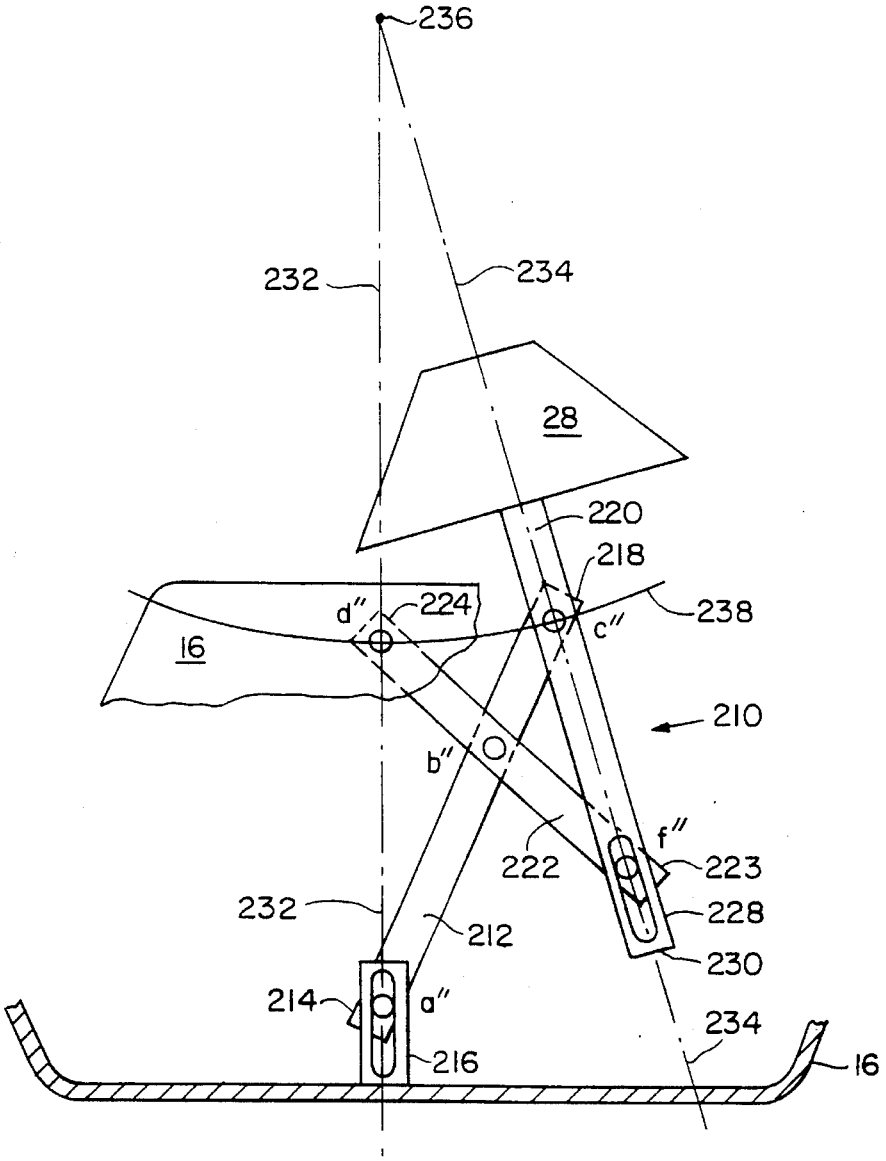
Figure 4B:
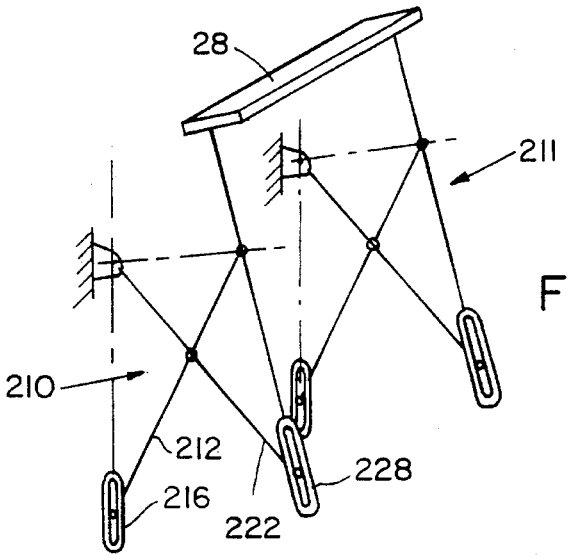
Figure 4C:
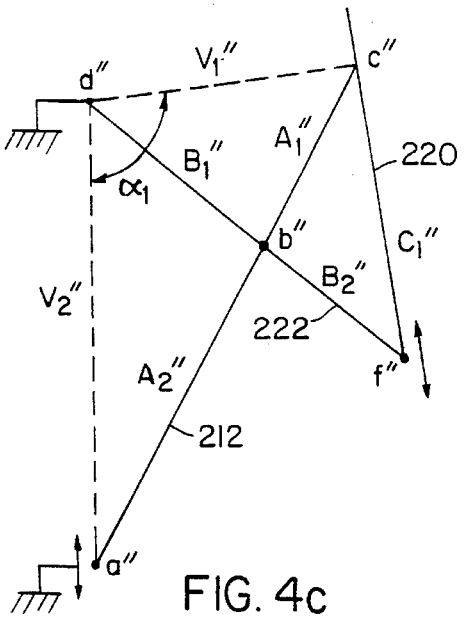

FIGS. 4*a*, 4*b*, and 4*c* are side, schematic perspective, and schematic side views, respectively, of yet another linkage assembly of the rocker seat.

Figure 4D:
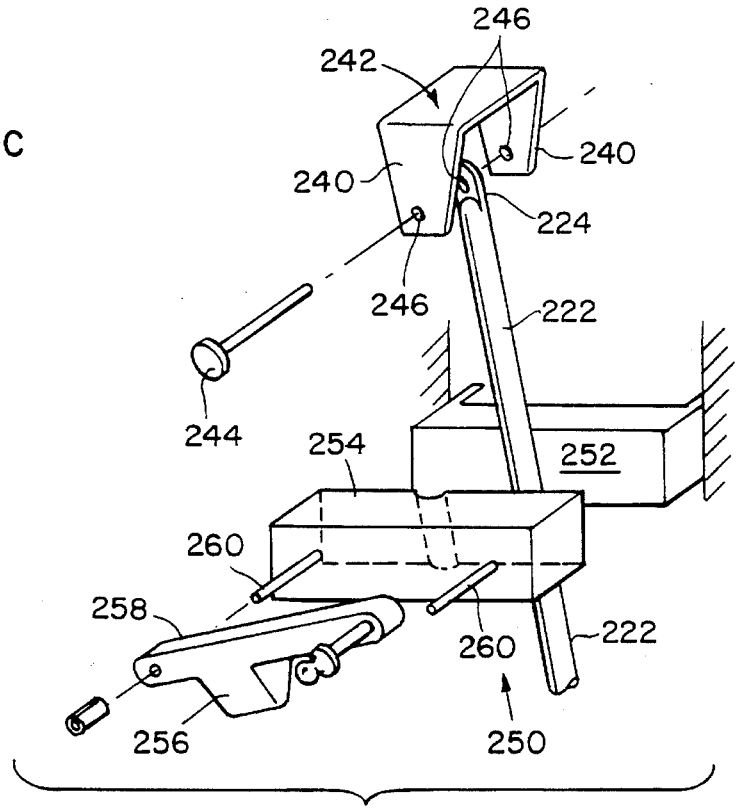
Figure 4E:
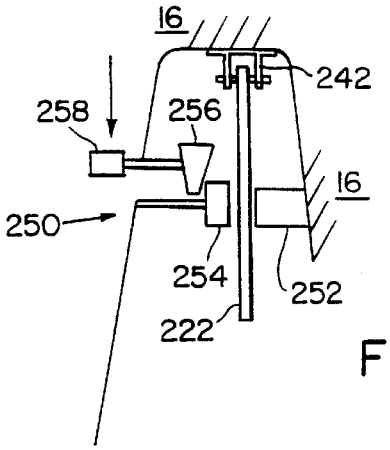

FIGS. 4*d* and 4*e* are exploded perspective and front views, respectively, of a brake mechanism for the rocker seat of FIGS. 4*a*, 4*b*, and 4*c*.

FIGS. 5*a* and 5*b* are side schematic views of mechanisms for driving the linkage assembly of FIGS. 2*a*, 2*b*, and 2*c*.

FIGS. 6*a* and 6*b* are perspective and side schematic views of an alternate linkage assembly.

Referring to FIG. 1*a*, a rocker seat 10 for rocking, e.g., an infant (not shown) includes a chair 12 supported by a frame 14. A housing 16 which serves as a support structure and attached at the base of frame 14 substantially encloses a linkage assembly 18, shown and described in detail below in connection with FIGS. 2*a*, 2*b*, and 2*c*. Links 20, 22 of linkage assembly 18 extend through slots 24, 26 in a shroud 27 at the top of frame 14, and attach at the base of a chair support 28. Slots 24, 26 allow links 20, 22 to translate fore and aft with respect to shroud 27 and frame 14. As links 20, 22 translate fore and aft with respect to frame 14, so also do chair support 28 and chair 12.

As shown in FIGS. 1*b*, 1*c*, and 1*d*, chair 12 releasably attaches, through a tilt/latching mechanism 29, to chair support 28. Tilt/latching mechanism 29 includes raised members 30 projecting from both sides of chair 12 (only one member 30 shown). When members 30 are slid into one of mating recesses 31 in the sides of chair support 28, a pin 32 at the top of each member 30 engages a hole 33 at the top of the selected recess 31, locking chair 12 to support 28. The angle of chair 12 with respect to support 28 is determined by the angle of the selected recesses 31. More recesses 31 may be provided in chair support 28 to allow for more precise control over chair angle.

Chair 12 may be released from chair support 28 in either of two ways. If pins 32 are rigidly attached to members 30, the sides of chair support 28 may be forced apart to free pins 32 from holes 33. Alternatively, if pins 32 are sprung with respect to members 30, as shown in FIG. 1*e*, depressing them allows chair 12 to be withdrawn from support 28.

With reference to FIGS. 2*a*, 2*b*, and 2*c*, linkage assembly 18 includes a fore linkage 34 and an aft linkage 36. (Seat 12 and tilt/latching mechanism 29 are not shown in FIGS. 2*a* and 2*b*. Frame 14, shroud 27, and aft linkage 36 are not shown in FIG. 2*b*. FIG. 2*c* is a schematic view of fore linkage 34.)

In fore linkage 34, links 20, 22 rigidly attach at the top side of a tubular sleeve 38, and a link 40 rigidly attaches at the bottom side of sleeve 38. Links 20, 22, 40, which may be formed from, e.g., 5/16" (0.79 cm) steel wire or rod, are all generally collinear. Links 20 and 40 together represent a first link of a linkage assembly. Together, sleeve 38 and links 20, 22, 40 form a Y-shaped yoke 42. The free ends 44, 46 of links 20, 22 are bent 90° and inserted into holes 48, 50 in the sides of chair support 28. Holes 48, 50 are sized to allow links 20, 22 to pivot with respect to support 28. The free end 52 of link 40 is likewise bent 90° and inserted into a slot 54 in a slider 56 which serves as a translation mechanism and attached to the floor 58 of housing 16. Slot 54, which extends along an axis 59, is sized to allow link 40 to slide and pivot with respect to slider 56.

Fore linkage 34 also includes a U-shaped yoke 60 having a horizontal cross-member 62 extending through the hollow interior of sleeve 38. Two parallel links 64, 66 project perpendicularly from opposite ends of horizontal cross-member 62. Link 64 represents a second link of the linkage assembly which includes links 20 and 40 which together represent the first link. The free ends 68, 70 of links 64, 66 are bent 90° and inserted into holes 72, 74 in the top of housing 16. Cross-member 62 and links 64, 66 may be formed from, e.g., a unitary section of ¼" (0.63 cm) steel wire or rod. The hollow interior of sleeve 38 is sized to allow U-shaped yoke 60 to pivot with respect to sleeve 38. Holes 72, 74 are sized to allow links 64, 66 to pivot with respect to housing 16.

Aft linkage 36 is substantially identical to fore linkage 34. The top of a U-shaped yoke 76 in aft linkage 36 is inserted into holes 78 in the top of housing 16 (only one hole 78 shown), allowing yoke 76 to pivot with respect to housing 16. The top of a Y-shaped yoke 80 (to which U-shaped yoke 76 pivotally attaches) in aft linkage 36 is inserted into holes 82 in the sides of support 28 (only one hole 82 shown), allowing yoke 80 to pivot with respect to support 28. Holes 82 are aft of holes 48, 50. The bottom of Y-shaped yoke 80 is inserted into a slot 83 of a slider 84 attached to the floor 58 of housing 16. Slot 83 extends along an axis 86. Slider 84 allows Y-shaped yoke 80 to pivot and slide with respect to housing 16. Axis 59 of slot 54 and axis 86 of slot 83 are inclined towards one another, intersecting with a vertical axis 88 of linkage assembly 18 (i.e., the vertical axis centered between holes 72, 78) at an approximate center point 90 located well above housing 16. The selection of the inclinations of axes 59, 86 is discussed in further detail below. Because of the construction of linkage assembly 18, the weight of fore and aft linkages 34, 36 is in most instances sufficient to cause linkage assembly 18 to return to its center position, i.e., the rotational orientation where fore and aft linkages 34, 36 lie on axes 59, 86, respectively.

Holes 72, 78 in housing 16 also lie along axes 59, 86, respectively. Thus, the arrangement of links, pivots, and sliders of each of the fore and aft linkages 34, 36 can be schematically represented as shown in FIG. 2*c*. $A_1$ and $A_2$ represent the respective lengths of links 20, 40, and $B_1$ represents the length of link 64. $V_1$, the distance along a line 92 extending from hole 72 (point d) to hole 48 (point c), varies with the orientation of the linkage, as does $V_2$, the distance along axis 59 from point d to the end of link 40 in slot 54 (point a). The junction of link 20 and link 40 defines point b.

Point d (holes 72, 74) of fore linkage 34 remains fixed with respect to housing 16 as the orientation of linkage 34 changes. Because of slot 54, the orientation of axis 59 also remains fixed with respect to housing 16.

A method for determining dimensions $A_1$, $A_2$, and $B_1$ of fore linkage 34 will now be described. Other methods should also be apparent from the details set forth herein. The dimensions of aft linkage 36 are determined in the same manner.

Generally, the external dimensions of rocker seat 10 are chosen in accordance with portability, ergonomic, manufacturing, marketing, shipping, and other considerations, and linkage assembly 18 is designed to fit within the available space. The location of point d (holes 72, 74) is usually selected to provide the maximum clearance between point d and the floor 58 of housing 16.

The desired path of travel of point c is next chosen. In particular, approximate center 90 (which lies along vertical axis 88) and a radius are selected to define a constant-radius path 94. The radius of path 94 may range from zero to infinity. Moreover, although center 90 in FIGS. 2*a* and 2*c* lies above path 94, it may instead be located below the desired path. While it may not precisely follow path 94, point c (holes 48, 50) lies generally on or near path 94 throughout its range of travel (note that hole 82, which defines point c for aft linkage 36, also lies on or near path 94 throughout its range of travel). Approximate center 90 and point d together determine the orientation of inclined axis 59. To avoid interference between free end 52 of link 40 and the bottom of slot 54 as fore linkage 34 rotates under point d and aligns with axis 59, the sum of $B_1$ and $A_2$ should not exceed Y, the distance along axis 59 between point d and the floor 58 of housing 16. Generally, the sum of $B_1$ and $A_2$ will approximately equal Y, the available clearance distance.

Once path 94 has been selected, X, the distance between point d and path 94 along axis 59, is then determined. For convention, X is positive if d lies above path 94, and negative if d lies below path 94. The maximum desired forward "stroke" (i.e., the maximum forward limit of travel of point c along path 94), is then chosen. With point c at it maximum stroke position, point a is at the top of slot 54.

With point c at its maximum stroke position (as shown in FIG. 2*c*), to graphically determine the location of point b, an arc of radius $r_1$ is swept from point c, and an arc of radius $r_1$ plus X is swept from point d. The intersection of these two arcs defines point $P_1$. Next, an arc of radius $r_2$ is swept from point c, and an arc of radius $r_2$ plus X is swept from point d to similarly define point $p_2$. A line drawn through points $P_1$ and $P_2$ intersects fore linkage 34 at point b. By selecting point b in this manner, $B_1$ equals $A_1$ plus X. Thus, when fore linkage 34 lies along inclined axis 59, point c lies on path 94. Note that because of the construction of fore linkage 34, the distance between point a and point c will generally be greater than the distance between point b and point d.

Because of the construction of fore linkage 34, it is possible to describe the location of point c as a function of $V_1$ and the angle $\alpha_1$ between line 92 and axis 59. From the law of cosines, it can be shown that:

$$(A_1+A_2)^2=V_1^2+V_2^2-2V_1V_2\cos(\alpha_1) \quad (1)$$

And because $\alpha_2$, the angle between link 40 and link 64, and $\alpha_3$, the angle between link 20 and link 64, are supplementary angles (and thus $\cos(\alpha_2 2)=-\cos(\alpha_3)$), it can be shown (also from the law of cosines) that:

$$V_2^2-A_2/A_1(A_1^2+B_1^2-V_1^2)+A_2^2B_1^2 \quad (2)$$

As discussed above, generally $B_1$ equals $A_1$ plus X, and $B_1$ plus $A_2$ equals Y. Thus, using the values of $A_1$, $A_2$, and $B_1$ determined above, equations (1) and (2) can be solved simultaneously to determine $V_1$ as a function of $\alpha_1$, Further, the lengths of slots 54, 83 may be determined by calculating the difference between $V_{2(max)}$ and $V_{2(min)}$, the maximum and minimum values, respectively, of $V_2$ for each linkage 34, 36 as holes 44, 82 move along their respective arcs.

As noted above, the axes 59, 86 of slots 54, 83 of sliders 56, 84 are inclined towards one another to intersect at approximate center 90. With axes 59, 86 inclined in this manner, support 28, and thus also chair 12, pivot as point c for each linkage 34, 36 (holes 48, 50, 82) travels on or near arc 94. In particular, a normal vector 96 projecting from the top of support 28 remains directed toward or near approximate center 90 as linkage assembly 18 rotates and slides about its various axes, much as if support 28 were a pendulum suspended from center 90. Accordingly, a child seated in chair 12 experiences a sensation similar to that of being swung from an overhead linkage hinged at approximate center 90, without the need for such a cumbersome overhead linkage.

Alternatively, the motion of chair 12 may be modified by varying the relative inclinations of axes 59, 86, so they no longer point at approximate center 90. For instance, keeping holes 72, 78 in the locations shown in FIG. 2*a*, sliders 56, 84 could be moved toward vertical axis 88 until they lie directly under holes 72, 78, respectively. In this configuration, axes 59, 86 of slots 54, 83 would be parallel, and holes 44, 82 (and thus also support 28 and chair 12) would remain generally horizontal as support 28 moves through its range of travel.

If space constraints, packaging or aesthetic concerns, structural support issues, or other considerations so dictate, linkage assembly 18 may be inverted, so that point d is located below point a (i.e., point d is at a point of lower gravitational potential energy than point a).

Moreover, pivot joints may be preferable to sliders in some applications. If so, sliders 56, 84 may be replaced with a link, pivoted at one end with respect to housing 16 and at the other end with respect to free end 52 of link 40, that is long enough to provide substantially straight motion at free end 52. Thus, each of these alternatives, the slider and the long link arrangement, comprises a translation mechanism or a translation means that allows free end 52 to translate along a substantially straight axis.

Both of these features are present in the embodiment shown in FIGS. 3*a*, 3*b*, 3*c*, and 3*d*. Linkage assembly 110 includes a fore linkage 112 and a substantially identical aft linkage 114. (Only one side of each linkage 112, 114 is shown in FIG. 3*a*. The side not shown is adjacent to linkage assembly 110, and is essentially a mirror image of the depicted side.) A link 116 in fore linkage 112 pivotally attaches at one end 118 (point d') to housing 16, and at the other end 120 (point b') to the middle region of a link 122. Link 122 pivotally attaches at one end 124 (point c') to chair support 28, and at the other end 126 (point a') to a long link 128 pivotally attached at point e' to housing 16 with this arrangement, long link 128 represents a third link pivotally connected at a first point to a support structure (housing 16) and pivotally connected at a second point to a first point of a first link 122. Thus, point a' moves through an arcuate path 130 determined by the location of point e', and the length of link 128. As explained above, link 128 is sufficiently long that path 130 is substantially straight, and thus approximates the behavior of a slider.

When chair support 28 is centered on vertical axis 132 of linkage assembly 110 (i.e., when chair support 28 is at the midpoint of its travel) (not shown), linkages 116, 122 lie along an inclined axis 134 defined by points a' and d'. Inclined axis 134 intersects vertical axis 132 at an approximate center point 136. In addition, when support 28 is centered in this manner, link 128 lies perpendicular to inclined axis 134, so that path 130 is tangent to inclined axis 134 at the point of perpendicularity. An inclined axis 138 defined by points a' and d' of aft linkage 114 similarly intersects approximate center point 136. The sizes of the various links in the fore and aft linkages 112, 114, as well as the locations of points a', b', c'and d', are selected as described above in connection with FIGS. 2*a*, 2*b*, and 2*c*.

As with linkage 18, support 28 pivots as linkage assembly 110 rotates, much as if support 28 were a pendulum suspended from center 136. Because of the construction of linkage assembly 110, if chair support 28 is unloaded (e.g., if chair 12 is not attached to support 28), the weight of fore and aft linkages 112, 114 may be sufficient to cause linkage assembly 110 to rotate to either its fore or its aft limit of travel. If this is the case, loading chair support 28 will typically cause linkage assembly 110 to return to its center position (i.e., the rotational orientation where fore and aft linkages 112, 114 lie on axes 134, 138, respectively).

A brake mechanism 140 for stopping the rocking motion of linkage assembly 110 and chair support 28 is shown in FIGS. 3*c* and 3*d*. Brake mechanism 140 includes a horizontal cross bar 142, to which a pair of brake pads 144 are rigidly attached, e.g., by welding. A second fore linkage 146, which is adjacent and substantially identical to fore linkage 112, includes a link 148 oriented parallel to link 116. Links 116, 148 project from opposite ends of horizontal cross bar 142, and are oriented substantially perpendicular to both cross bar 142 and the top surfaces of brake pads 144. Thus, as links 116, 148 rotate about pivots 118, 148, so also do cross bar 142 and brake pads 144.

Brake mechanism 140 further includes a brake bar 150 pivotally attached via hinges 152 to housing 16. A light spring 154 attached to a top region of housing 16 holds the free end of brake bar 150 up. Hinges 152 are located so that when brake bar 150 is forced against spring 154 towards housing 16 (in the direction indicated by the arrows in FIGS. 3*c* and 3*d*), portions of brake bar 150 come into contact with brake pads 144, and force links 116, 148 to align with inclined axis 134. Thus, pressing down on brake bar 150 centers linkage assembly 110, and arrests its rotation.

As shown in FIGS. 4*a*, 4*b*, 4*c*, 4*d*, and 4*e*, another embodiment of a linkage assembly for the rocker seat employs two pair of adjacent, and substantially identical, linkages 210, 211. A link 212 in linkage 210 connects at one end 214 (point a") to a slider 216 attached to housing 16. The other end 218 of link 212 (point c") pivotally attaches to a link 220 extending perpendicularly from the base of chair support 28. Another link 222 pivotally attaches at one end 224 (point d") to housing 16, and at the other end 223 (point f") to a slider 228 at the end 230 of link 220. The axis 232 of slider 216 extends through point d" (pivot 224) .

Similar to the embodiment shown in FIGS. 3*a* and 3*b*, linkage assembly 210 could be inverted, and slider 216 could be replaced with a long link arm pivoted at both ends.

The dimensions $A_1$", $A_2$", and $B_1$" of linkage assembly 210, as well as the locations of points a", b", c", and d", are selected as described above in connection with FIGS. 2*a*, 2*b*, and 2*c*. Note that in linkage 210, point d" (pivot 224) lies on arc 238. Thus, $B_1$" equals $A_1$". The length $B_2$" between points b" and f" as well as the length $C_1$" between points c" and f", are chosen so that the axis 234 of slider 228 intersects the axis 232 of slider 216 at or near the approximate center 236 of the arc 238 through which point c" (pivot 218) sweeps. Thus, link 220 and the portion of link 222 extending between point b" and point f" comprise a load control mechanism, keeping support 28 properly oriented as linkage assembly 210 rotates, much as the fore and aft linkages in linkages assemblies 18, 110 cooperate to keep support 28 oriented. As with linkage assemblies 18, 110, support 28 pivots as linkage 210 rotates, much as if support 28 were a pendulum suspended from center 236.

The details of the pivot joint between link 222 and housing 16 are shown in FIGS. 4*d* and 4*e*. The flattened end 224 of link 222 is inserted between the lobes 240 of a U-shaped bracket 242 attached to housing 16. A rivet 244 inserted through holes 246 in the lobes 240 of U-shaped bracket 242 and flattened end 224 allows link 222 to pivot with respect to bracket 242.

A brake mechanism 250 for stopping the rocking motion of linkage assembly 210 and chair support 28 is also shown in FIGS. 4*d* and 4*e*. Brake mechanism 250 includes a fixed brake pad 252, made of a compliant material such as rubber, attached to housing 16. Throughout its range of travel, link 222 remains between fixed brake and 252 and an opposed movable brake pad 254, which is also made of a compliant material such as rubber. A wedge 256 engages the back side of movable brake pad 254. When a handle 258 attached to wedge 256 is rotated downward in the direction indicated by the arrow in FIG. 4*e*, wedge 256 forces movable brake pad 254 along slider pins 260 toward fixed brake pad 252, trapping link 222 in between.

Although in many applications chair 12 may be satisfactorily moved fore and aft by the movement of the person seated therein, in some applications it may be desirable to drive the linkage assembly so as to cause the chair to oscillate. Drive mechanisms 310, 312 for fore linkage 34 of linkage 18 (FIGS. 2*a*, 2*b*, and 2*c*) are shown in FIGS. 5*a* and 5*b*. Of course, mechanisms 310, 312 could be readily modified for use with other linkages, such as linkages 110, 210.

Drive mechanism 310 includes an electric or spring motor 314 that drives a pinion gear 316 through a worm gear 318. A link 320 pivotally attaches at one end to pinion gear 316, and at the other end to a short link section 322. Short link section 322 is pivotally attached to housing 16 at or near hole 72 (i.e, the pivot joint between link 64 and housing 16). A spring steel blade 324, laterally constrained at its midpoint by pins 326 projecting from link 64, attaches to the free end of short link section 322.

As pinion gear 316 rotates, link 320 causes short link section 322 to pivot back and forth. Through the compliant connection provided by spring steel blade 324, this imparts a lateral force to pins 326 and link 64, causing fore linkage (and thus also chair 12, not shown) to rotate. The motor speed may be adjusted to drive the linkage at or near its natural frequency.

Drive mechanism 312, shown in FIG. 5*b*, is similar to drive mechanism 310, except a spring 328 connects at one end to pinion gear 316, and at the other to link 64.

Other embodiments are within the claims.

For example, although in the embodiments shown and described above the links are straight, they may be bent or otherwise shaped as necessary. As illustrated in FIGS. 6*a* and 6*b*, a linkage assembly 410 includes a U-shaped yoke 412 pivotally mounted to housing 16 by pivot joints 414, and a Y-shaped yoke 416, one end 417 of which slides in a slider 418 attached to housing 16. A load such as a chair support 28 (not shown) may be coupled, through pivot joints 420, to the top of Y-shaped yoke 416. U-shaped yoke 412 passes through holes 422 in a pair of lobes 424 attached, e.g., by welding, to the upright arms of Y-shaped yoke 416. As shown in FIG. 6*b*, Y-shaped yoke is bent so that end 417, pivot joints 420, and holes 422 are collinear. Linkage assembly 410 may for example be substituted for either or both of the fore and aft linkages 34, 36 of the embodiment shown in FIGS. 2*a*, 2*b*, and 2*c*.

What is claimed is:

1. Apparatus comprising:

a support structure;

a linkage assembly including:

a first link connected at a first point to a translation mechanism attached to said support structure, said translation mechanism arranged to allow said first point of said first link to translate along a substantially straight axis;

a second link pivotally connected at a first point to said support structure and pivotally connected at a second point to said first link;

wherein a second point of said first link travels on or near an arc of substantially constant finite radius when said first link pivots with respect to said second link.

2. Apparatus in accordance with claim 1 wherein said translation mechanism comprises a slider.

3. Apparatus in accordance with claim 1 wherein said translation mechanism comprises a third link pivotally connected at a first point to said support structure and pivotally connected at a second point to said first point of said first link.

4. Apparatus in accordance with claim 1 wherein said axis intersects a center of said arc.

5. Apparatus in accordance with claim 1 wherein the distance between said first and said second points of said first link is greater than the distance between said first and said second points of said second link.

6. Apparatus in accordance with claim 1 wherein said axis intersects said first point of said second link.

7. Apparatus in accordance with claim 6 wherein the distance between said first and said second points of said second link approximately equals the distance between said second point of said second link and said second point of said first link plus the distance along said axis between said first point of said second link and said arc.

8. Apparatus in accordance with claim 1 and further comprising a load pivotally attached at said second point of said first link.

9. Apparatus in accordance with claim 8 wherein said load is a chair support.

10. Apparatus in accordance with claim 9 and further comprising a chair releasably attached to said chair support.

11. Apparatus in accordance with claim 8 and further comprising a load control mechanism to control a rotational orientation of said load.

12. Apparatus in accordance with claim 11 wherein said load control mechanism includes a second one of said linkage assemblies.

13. Apparatus in accordance with claim 12 wherein said axis of said second linkage assembly intersects said axis of said linkage assembly at or near a center of said arc.

14. Apparatus in accordance with claim 11 wherein said load comprises a fourth link, and wherein said load control mechanism includes a second translation mechanism attached to said fourth link, said second translation mechanism arranged to allow a third point of said second link to translate along a substantially straight second axis with respect to said fourth link.

15. Apparatus in accordance with claim 14 wherein said second translation mechanism comprises a slider.

16. Apparatus in accordance with claim 14 wherein said second axis of said second translation mechanism intersects said axis of said translation mechanism at or near a center of said arc.

17. Apparatus in accordance with claim 1 wherein said first link is substantially straight.

18. Apparatus in accordance with claim 1 wherein said second link is substantially straight.

19. Apparatus in accordance with claim 1 wherein said first point of said first link is below said first point of said second link.

20. Apparatus in accordance with claim 1 wherein said first point of said first link is above said first point of said second link.

21. Apparatus in accordance with claim 1 and further comprising a brake mechanism for arresting the motion of said linkage assembly.

22. Apparatus in accordance with claim 1 and further comprising a drive mechanism for driving said linkage assembly.

23. Apparatus in accordance with claim 22 wherein said drive mechanism includes a motor and a spring.

24. The apparatus in accordance with claim 1 wherein the second point where the second link is pivotally connected to the first link is disposed intermediate the first point where the first link is connected to the translation mechanism and the second point of the first link.

25. Apparatus comprising:

a support structure;

first and second linkage assemblies, each of said linkage assemblies including:

a first link connected at a first point to a translation mechanism attached to said support structured said translation mechanism arranged to allow said first point of said first link to translate along a substantially straight axis;

a second link pivotally connected at a first point to said support structure and pivotally connected at a second point to said first link;

a member connecting a second point of said first link of said first linkage assembly and a second point of said first link of said second linkage assembly.

26. Apparatus in accordance with claim 25 wherein said second point of said first link of said first linkage assembly and said second point of said first link of said second linkage assembly travel on or near an arc of substantially constant radius when said first links pivot with respect to said second links.

27. Apparatus comprising:

a support structure;

a linkage assembly including:

a first link connected at a first point to a translation mechanism attached to said support structure, said translation mechanism arranged to allow said first point of said first link to translate along a substantially straight axis;

a second link pivotally connected at a first point to said support structure and pivotally connected at a second point to said first link;

a load attached to said first link; and a load control mechanism to control a rotational orientation of said load.

28. Apparatus in accordance with claim 27 wherein said load control mechanism includes a second one of said linkage assemblies.

29. Apparatus in accordance with claim 27 wherein said load comprises a fourth link, and wherein said load control mechanism includes a second translation mechanism attached to said fourth link, said second translation mechanism arranged to allow a third point of said second link to translate along a substantially straight second axis with respect to said fourth link.

* * * * *